United States Patent [19]

Engelsen et al.

[11] 4,386,874

[45] Jun. 7, 1983

[54] METHOD FOR INSTALLATION OF A MOORING CABLE

[75] Inventors: Per-Einar Engelsen, Drøbak; Reidar O. Nybo, Heggedal, both of Norway

[73] Assignee: A/S Akers Mek. Verksted, Oslo, Norway

[21] Appl. No.: 131,272

[22] Filed: Mar. 17, 1980

[30] Foreign Application Priority Data

Mar. 19, 1979 [NO] Norway ..... 790922

[51] Int. Cl.[3] ..... B63B 21/50; B63B 35/44

[52] U.S. Cl. ..... 405/224; 114/264; 114/293; 405/195

[58] Field of Search ..... 405/169, 195, 202, 224; 114/264, 293, 294, 230

[56] References Cited

U.S. PATENT DOCUMENTS

| | | | |
|---|---|---|---|
| 3,535,883 | 10/1970 | Manning | 405/224 X |
| 3,563,042 | 2/1971 | Ryan | 405/202 |
| 3,983,708 | 10/1976 | Houot | 405/195 |
| 3,988,898 | 11/1976 | McDonald | 405/224 |
| 4,048,945 | 9/1977 | Shrum | 405/224 X |

*Primary Examiner*—David H. Corbin

*Attorney, Agent, or Firm*—Watson, Cole, Grindle & Watson

[57] ABSTRACT

A method of mooring a vessel to an anchoring structure connected into the floor of a body of water wherein a drum containing a coiled mooring cable is lowered down to the anchoring structure, a first end of the coiled mooring cable is attached to the anchoring structure, and the second end of the mooring cable is then raised and attached to the vessel to be moored, while the drum with remaining coiled mooring cable remains adjacent the anchoring structure below the water's surface.

6 Claims, 4 Drawing Figures

METHOD FOR INSTALLATION OF A MOORING CABLE

BACKGROUND OF THE INVENTION

1. Field of the Invention

The present invention relates to a method for installation of a mooring cable or the like for a vessel, preferably for a floating platform structure of the tension moored type, where the mooring cable is connected between the vessel and a point of attachment on the sea floor. The invention also relates to a device for mooring a vessel.

2. The Prior Art

A method of the above type is disclosed in U.S. Pat. No. 3,563,042. In this method a mooring cable is brought out to the installation site rolled up on a reel which is rotatably supported about a horizontal axis on the platform structure. While the platform structure is held in place at the installation site, the mooring cable is rolled off the reel until its lower end reaches down to the sea floor. Here the cable is connected to an already installed attachment point, whereafter the cable is tensioned and secured in the platform structure.

Since tension-moored platforms preferably are used at greater ocean depths, e.g. above 150 m, the mooring cables become correspondingly long. Furthermore, such platforms are usually of substantial size, which again necessitates great dimensions in the mooring cables. The result is that each mooring cable becomes very heavy.

The mooring cables will in use be subjected to very high, partly varying tension loads, and for various reasons it is necessary to give them a very effective protection against corrosion. This is usually done by providing the cables with an outer layer or sleeve or a polymer material, e.g. polyethylene. Even though this protective layer is made relatively thick and is also reinforced, it will nevertheless have a relatively limited resistance against mechanical loads, especially strong, localized external pressure loads.

If a long and course cable of this type was rolled off from a reel as shown in the above-mentioned U.S. patent, the weight of the freely suspended part of the cable would be very high before the lower end of the cable would reach the bottom. This high weight would lead to very high external pressure loads on the cable at the point where it is rolled off the spole. This pressure loading would simply crush the external corrosion protection layer of the cable and thus make this layer ineffective. In addition, such damage would primarily take place in the upper part of the cable which in use would be located in the upper, warmer water layers having high corrosiveness.

Thus, it is the purpose of the invention to provide a method and system of mooring which avoids these drawbacks.

SUMMARY OF THE INVENTION

In accordance with the present invention the mooring cable or the like, preferably in the form of a coil or the like, is lowered down to the sea floor where one end of the cable is connected to the attachment point, whereafter the other end of the cable is raised to the vessel and connected thereto.

Further advantageous features of the invention will be apparent from the following description, taken in conjunction with the accompanying drawings, of an exemplifying embodiment of the invention.

DETAILED DESCRIPTION OF THE PREFERRED EMBODIMENT

Figure 1:
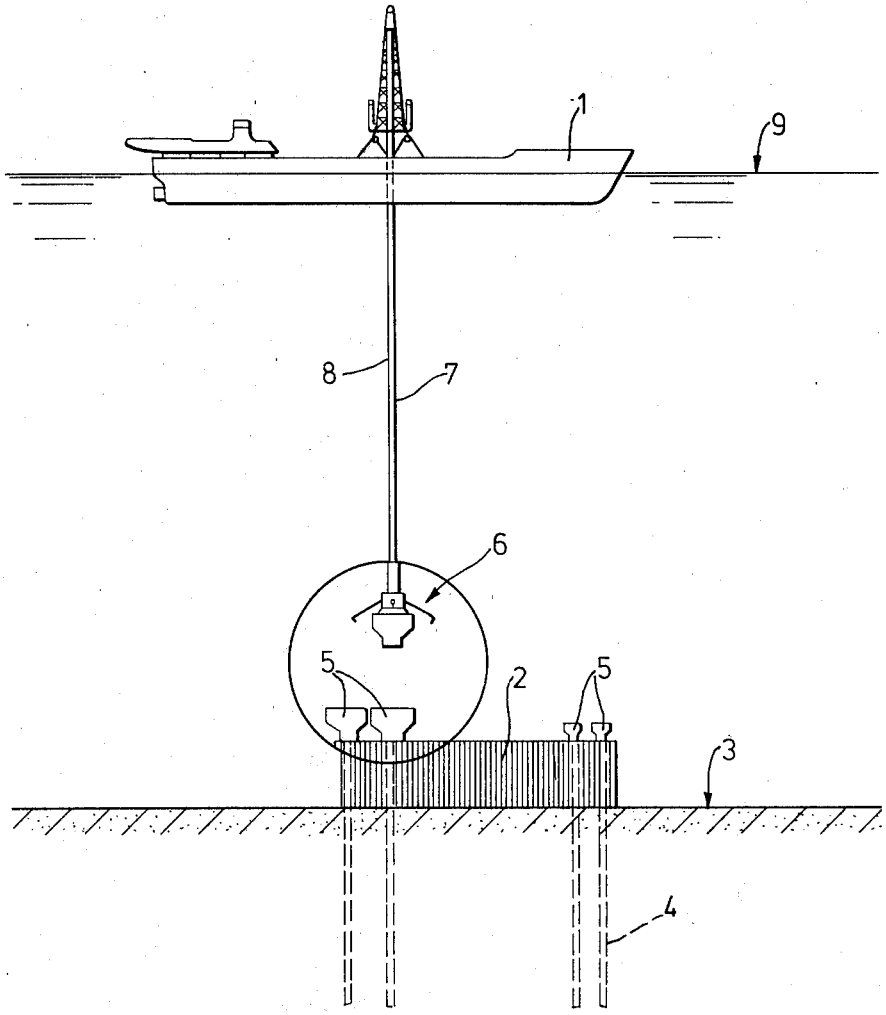
FIGS. 1 and 2 each illustrate a phase of the method according to the invention.

In FIG. 1 a drilling vessel in the form of a ship 1 is shown in position above a base plate 2 on the sea floor 3. The base plate 2 is anchored to the sea floor by means of piles 4, the upper ends of which extend somewhat up above the base plate and are provided with attachment points 5 for the lower end of mooring cables for a floating platform structure which later is to be moored in place above the base plate 2.

FIG. 1 furthermore shows a device 6 seen in enlarged detail within the circle which contains a mooring cable. This device 6 is in the process of being lowered down to the sea floor, the device being suspended in a hoisting wire 7 below the ship 1. The device 6 is guided by the aid of means known per se so that it will hit a funnel-shaped extension portion of the attachment point 5 and be guided into correct position with respect thereto. Thereafter, one end of the cable is connected to the attachment point in a suitable manner, for instance by means of remote control.

When the mooring cable is thus submerged in the sea to a point near the sea floor 3 and is attached to the attachment point 5, the hoisting wire 7, together with any positioning equipment, is freed from the device 6 and brought back to the ship 1. However, it is advantageous to connect a line 8 to the end of the cable which is not connected to the attachment point 5. This line 8 must be long enough to reach the sea surface 9, where it is provided with a float or buoy signalling the end point of the line and making it possible to fetch this end at a later time.

Figure 2:
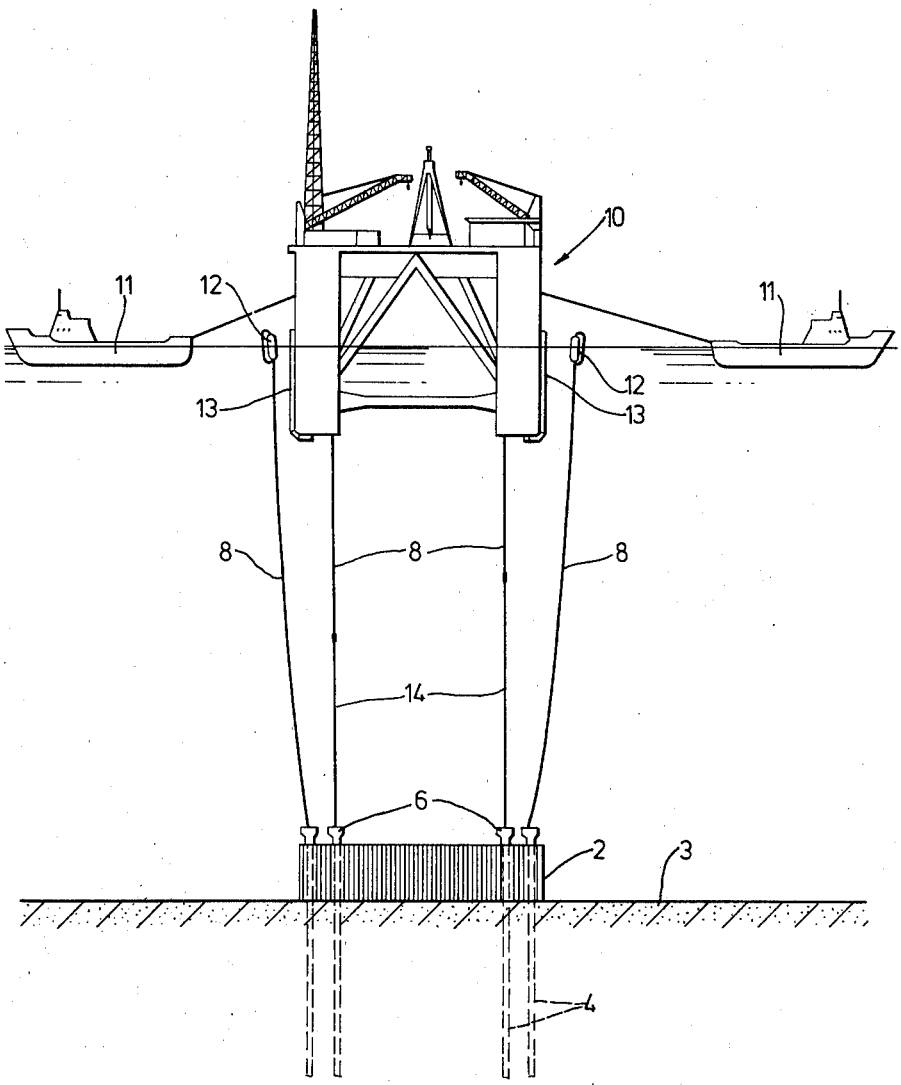

When all mooring cables in this way have been lowered down to the sea floor and have been attached to their respective attachment points 5, the ship 1 is removed. FIG. 2 illustrates what next takes place:

The platform structure 10 to be moored above the base plate 2 is brought in place thereover and held in position, e.g. by means of tugs 11. The lines 8 then are freed from the floats 12 and run in through the bottom of the platform structure 10 and through the respective cables' attachment point therein. This introduction of the lines 8 may for instance take place by connecting the lines at the ocean surface to further lines 13 which, before the platform structure was floated out to the site, were run down through the attachment point for the cable, out through the bottom of the platform structure and up on the outside thereof to a level above the ocean surface 9. This enables the lines 8 and 13 to be connected to each other in a convenient manner without the use of divers.

When in this manner the lines 8 have been brought into the platform structure 10, they are used to raise the end of the mooring cables 14 which are not attached to the attachment points 5, up to and into the platform structure 10. Here the mooring cables 14 are attached and tensioned in a suitable manner.

Figure 3:
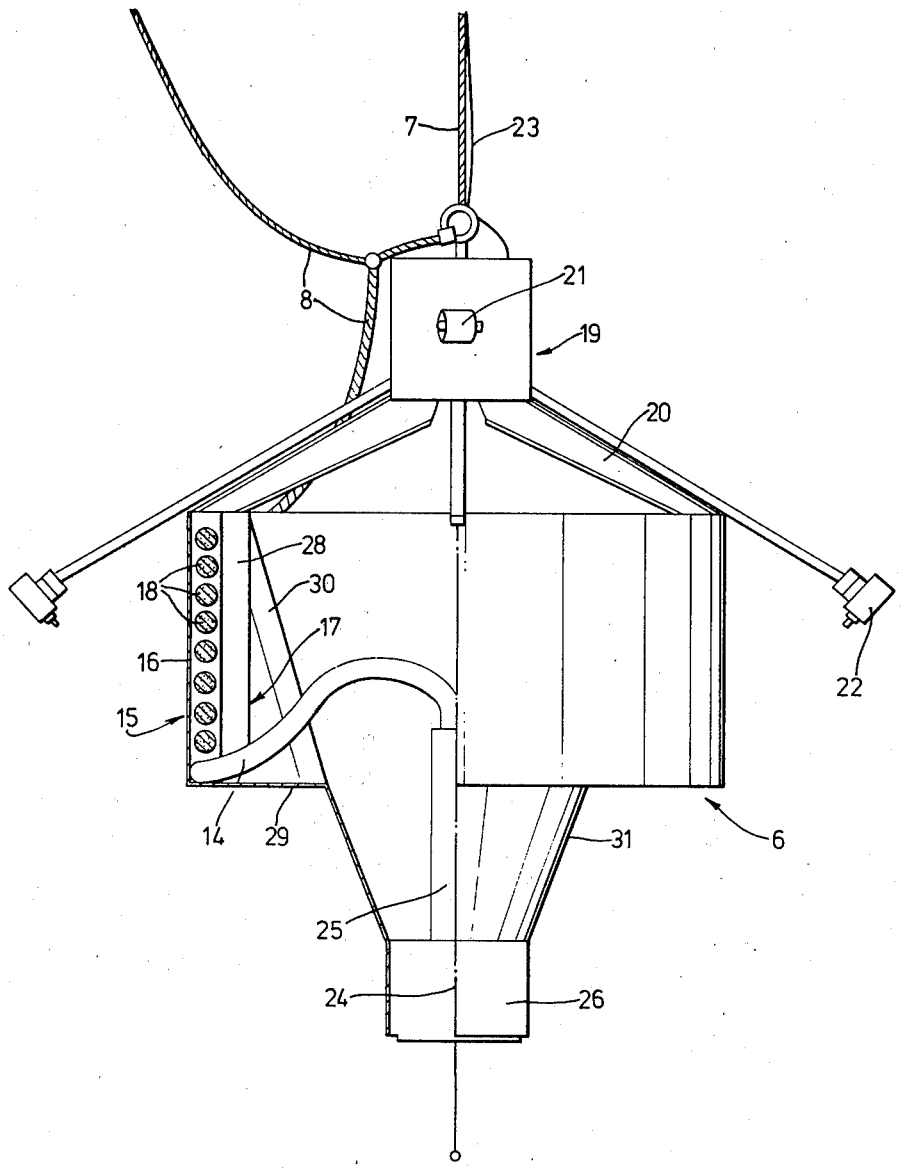
FIG. 3 shows, partly in section, a side view of an examplifying embodiment of a device according to the invention.
Figure 4:
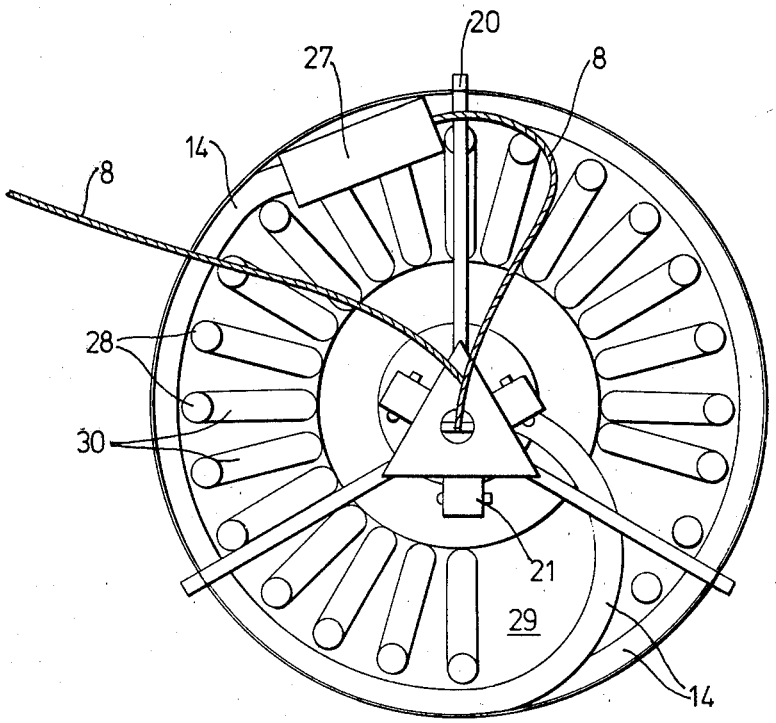
FIG. 4 shows a top view of a device according to the invention.

FIGS. 3 and 4 show further details of the device 6. This device comprises a drum-like means generally designated 15 for the mooring cable 14. The drum 15 comprises an outer, generally cylindrical shell 16 and an inner core 17 which together define an annular space for the coils 18 of the cable 14.

The drum 15 is suspended in the hoisting wire 7 by means of a supporting device which is generally designated 19 and which comprises three generally radially extending beams 20 which at their outer ends are removably attached to the drum 15. The suspension device 19 is also provided with positioning equipment in the form of thrusters 21 and TV-cameras 22. A signal and power cable 23 connects the positioning equipment with the ship 1. The suspension device causes the drum 15 to hang with its central axis 24 generally vertically.

The device 6 is also provided with an attachment means 25 for one end of the cable 14. This attachment means 25 has a lower coupling part 26 which in a suitable manner may be locked to one of the attachment points 5 on the base plate 2. The attachment means 15 and its coupling part 26 are, in the embodiment shown, arranged in or near the central axis 24 of the drum and thus provide a symmetrical structure which is robust, simple to manufacture and easy to position. However, the attachment means 25 may be placed closer to the periphery of the drum if this is desired or necessary in order to obtain a less strong curvature of the end part of the cable 14 extending between the attachment means 25 and the cable coil.

In the exemplifying embodiment shown the free radial distance between the outer shell 16 of the drum means 15 and the inner core 17 is marginally greater than the diameter of the cable 14. The coils 18 of the cable will therefore be placed directly above each other, so that each coil will not be jammed between neighbouring coils and one of the walls of the drum. If the cable 14 is so long that a cable coil following a single helix will entail too great a height of the drum means, the cable may be coiled along several consentric helices. In this case it will be advantageous to make the radial distance between the outer shell 16 and the core 17 approximately equal to an integer multiple of the diameter of the cable, again to avoid tendencies for jamming between the respective cable coils and the walls of the drum.

As is apparent from FIG. 4, the upper end of the cable coil 14 is attached to the line 8 which is used to pull the cable up to the platform structure 10 to be moored. Since the cable coil forms an helix which is extended when the cable is raised to the platform structure, the cable will concurrently be twisted about its axis. In order to avoid such twisting, a swivel 27 is positioned between the upper end of the cable 14 and the line 8.

Due to its elasticity the coils 18 of the cable 14 will press against the inner surface of the outer shell 16 of the drum 15. This is especially the case for the coil which is the uppermost at a given time during raising of the cable. In order that the relatively sensitive outer corrosion protecting layer not to be easily damaged during this operation, the inside of the drum, particularly the inner surface of the drum shell 16, is provided with a smooth and even surface. This inside may advantageously be provided with a friction-reducing material.

The inner core 17 of the drum 15 may advantageously consist of mutually spaced pieces of pipe 28 which are connected to the outer shell 16 by means of an annular end plate 29. The pipe pieces 28 are supported by means of further pipe pieces 30 which extend at an angle between the end plate 29 and the upper end of the respective pipe pieces 28. Thus, a light weight, robust and inexpensive structure is obtained.

The annular end plate 29 is at its inner periphery attached to a downwardly extending conical section 31 holding together the attachment means 25 and the coupling part 26. The conical section 31 has a guiding function when the coupling part 26 is brought together with the attachment point 5, and together with the outer shell 16 of the drum and the end plate 29 the conical section 31 act to give the device 6 a generally smooth and tight outer form enhancing its usefulness and protecting the cable.

The diameter of the drum device 15 should preferably be more than four times greater than the lowest radius of curvature the cable 14 may be subjected to without permanent deformations being caused therein. Thereby it will be relatively simple to bring the cable 14 in place in the drum device without weakening of the cable occuring where it is attached to the attachment means 15. If the device 6 is to be brought in place on the sea floor by means of a drilling vessel, it is on the other hand advantageous if the greatest diameter of the drum device is less than the diameter of the cellar deck opening of the drilling vessel. Hence the device 6 may be mounted in a simple manner by means of the hoisting equipment in the drilling tower of the drill ship, for instance along the well known and proven guidelines used in installing blowout preventors. On the basis of the most usual drilling vessels, the drum may advantageously have a diameter of about 5 m.

From the preceeding exemplifying embodiment it should clearly appear that the invention provides a method and a device facilitating the installation of a mooring cable between a platform structure and the sea floor without subjecting the cable to high external pressure loads. Furthermore, it will be apparent that the invention may be varied and modified and still fall within the scope of the appended claims. The vessel to be moored may itself be used for lowering the mooring cables instead of using another vessel for this work. However, the vessel to be moored will often represent a very substantial investment, and for this reason it may be desirable to moor the vessel in place as quickly as possible after it has been finished and brought out to the installation site. In many cases, therefore, it will pay to use another vessel for doing this work in advance. Furthermore, there may be economical and practical advantages in using a drilling vessel for the lowering work. This vessel will have the necessary equipment both for the lowering operation and for holding the vessel in place during this operation. Thus, the need to use special equipment on the vessel to be moored is avoided and, furthermore, avoids prolonged use of tugs or other equipment in order to hold the vessel in place is not required.

What is claimed is:

1. A method of mooring a vessel to an anchoring means connected to the floor of a body of water, said method comprising the steps of (a) lowering a drum-like means which contains a coiled mooring cable having a first end and a second end below the surface of the body of water such that it remains generally vertically oriented during its descent, (b) attaching the first end of the coiled mooring cable to the anchoring means, (c) raising the second end of the coiled mooring cable to the surface of the body of water while unwinding the mooring cable from the coil thereof which remains adjacent the anchoring means, and (d) attaching the second end of the coiled mooring cable to the vessel to be moored.

2. The method of mooring a vessel according to claim 1 which includes the steps of attaching a line to the second end of the coiled mooring cable, and wherein in step (c) the raising of the second end of the coiled mooring cable is achieved by raising the line.

3. The method of mooring a vessel according to claim 2 wherein the vessel to be moored includes an attachment opening therein and wherein the method includes the step of running the line through the attachment opening in the vessel.

4. The method of mooring a vessel according to claim 2 wherein the second end of the coiled mooring cable is caused to swivel with respect to the line as it is raised in step (c).

5. The method of mooring a vessel according to claim 1 wherein the lowering of the drum-like means which contains the coiled mooring cable in step (a) is achieved by a first vessel and wherein the raising of the second end of the coiled mooring cable in step (c) is achieved by a second vessel to be moored.

6. The method of mooring a vessel according to claim 5 wherein the first vessel is a drilling vessel.

* * * * *